US007482547B2

(12) United States Patent
Katsumoto et al.

(10) Patent No.: US 7,482,547 B2
(45) Date of Patent: Jan. 27, 2009

(54) PUSH BUTTON SWITCH WITH BACKLIGHT FUNCTION

(75) Inventors: Kenji Katsumoto, Tsurugashima (JP); Tsunetaka Shibata, Tsurugashima (JP)

(73) Assignee: Toyo Denso Co., Ltd., Tokyo (JP)

( * ) Notice: Subject to any disclaimer, the term of this patent is extended or adjusted under 35 U.S.C. 154(b) by 24 days.

(21) Appl. No.: 11/509,004

(22) Filed: Aug. 24, 2006

(65) Prior Publication Data

US 2007/0045093 A1 Mar. 1, 2007

(30) Foreign Application Priority Data

Aug. 26, 2005 (JP) ..... 2005-245291

(51) Int. Cl.
*H01H 9/00* (2006.01)

(52) U.S. Cl. ..... 200/314; 200/310

(58) Field of Classification Search ..... 200/310, 200/314

See application file for complete search history.

(56) References Cited

U.S. PATENT DOCUMENTS

| | | | | |
|---|---|---|---|---|
| 5,252,798 | A | 10/1993 | Kamada | |
| 6,207,913 | B1 * | 3/2001 | Nakajima et al. | 200/314 |
| 2002/0079208 | A1 * | 6/2002 | Campana et al. | 200/310 |
| 2002/0139651 | A1 * | 10/2002 | Zysnarski et al. | 200/310 |
| 2005/0067268 | A1 * | 3/2005 | Hurrle | 200/314 |

FOREIGN PATENT DOCUMENTS

| | | | |
|---|---|---|---|
| DE | 92 12 062 | U1 | 10/1992 |
| DE | 44 14 981 | A1 | 11/1995 |
| JP | 8-64062 | A | 3/1996 |

OTHER PUBLICATIONS

Search Report dated Apr. 8, 2008 issued in corresponding European Application No. 06 25 4229.

* cited by examiner

*Primary Examiner*—Elvin G Enad
*Assistant Examiner*—Lheiren Mae A Anglo
(74) *Attorney, Agent, or Firm*—Westerman, Hattori, Daniels & Adrian, LLP.

(57) ABSTRACT

It is an object of the present invention to provide a push button switch in which is achieved a light blocking structure that is efficient and permits the button to be pushed in, disposed adjacent to other push button switches on the same substrate in a direction perpendicular to the direction in which the button is pushed in, so that the light from light sources assigned different functions will not interfere one with the other. The push button switch of the present invention comprises LEDs disposed adjacent to each other on the same substrate, two light barriers erected apart from each other and in between the LEDs, and one light barrier provided on the back side of a control knob, wherein the distal end of the one light barrier is in a positional relationship of fitting into the gap between the two light barriers, and the two light barriers are tall enough to permit the displacement of the one light barrier when the control knob is pushed in.

2 Claims, 4 Drawing Sheets

CONVENTIONAL SPECIFICATION

PRIOR ART

PUSH BUTTON SWITCH WITH BACKLIGHT FUNCTION

BACKGROUND OF THE INVENTION

1. Field of the Invention

The present invention relates to a push button switch device, which is a control switch installed in the instrument panel of an automobile or the like, and which is equipped with a backlight function that allows the operation position and operation state to be identified so as to facilitate nighttime operation.

2. Description of the Related Art

Some of the push button switches that are installed in automobiles, consumer electronics, and so forth are provided with a light for illuminating the switch so that it can be found in the dark, such as at night, and with a light for displaying the operational state, with these lights provided next to each other. Since lights having different meanings come on at locations that are very close together, if there is any light leakage between the two it can lead to a misreading of the information, and there has been a need for a switch structure that is free of light leakage. The present applicant has previously manufactured the push button automobile heater control switch shown in FIG. 5. This switch is what is known as a push-push switch; when the driver pushes a control knob 1, a slide contact 5 moves and the switch is turned on and held in this depressed position. When the driver again pushes the control knob 1, the switch is turned off and the control knob 1 is returned by a spring 6 to its original position. 2' in FIG. 5 is a miniature lamp used for nighttime illumination, so that the location of the switch can be found even in the dark. 3' is another miniature lamp, which tells the driver whether the switch is on or off. This lamp is lit when the control knob 1 is pushed and the switch is turned on, and is extinguished with the control knob 1 is again pushed and returns to its home (off) position. The light from the lamp 3' indicating whether the switch is on or off goes through a light transmitting member 7 and reaches the surface of the control knob 1. In contrast, when the nighttime illumination lamp 2' is lit, its light shines directly on the back of the control knob 1 and lights up a wide area of the surface. In order for the driver to be able to distinguish between these two lights, the space on the back side of the control knob 1 is such that the region in which the light transmitting member 7 is disposed is completely isolated by a light barrier 4.

This conventional switch employed miniature lamps as the light source for both nighttime illumination and operational display, but there has been demand for replacing these with LEDs because the latter last longer and consume less power, and switch design has already begun moving in that direction. When LEDs are employed in place of conventional miniature light bulbs, connecting and attaching the terminals of the various LEDs in small divided spaces entails a lot of work, so it is preferable to use a structure in which the LEDs are all attached to a single substrate ahead of time and then incorporated into the switch. Also, the miniature light bulbs of conventional devices were installed from a direction perpendicular to the direction in which the switch was depressed, but the installation conditions of peripheral devices can require installation in the operational axis direction, and the substrate has to be in a perpendicular relationship with the operational axis. However, if this type of push button switch has movable parts, and two LEDs are disposed on a substrate perpendicular to the operational axis, then a light barrier that blocks the light from these LEDs also has to have a movable structure.

An invention titled "Push Button Switch," published as Japanese Laid-Open Patent Application H8-64062 and disclosed in Japan on Mar. 8, 1996, is a push button switch that employs an LED for its light source, and presents a structure in which light leaks between adjacent switches. The top drawing in FIG. 6 is a front view thereof, the lower left drawing is the right portion of a cross section along the B-B line, and the lower right drawing is an enlarged view of the light blocking structure of the control button. This switch operates as follows. When a control button 13 is operated to turn on a switch fixed on a printed substrate 18, an LED fixed to this printed substrate 18 is lit, and the function corresponding to the control button 13 is also performed. When a bulb 17 provided for nighttime illumination on the printed substrate 18 is lit, the light emitted from the bulb 17, other than the portion that illuminates a display component 10*a*, is reflected by the inner walls of the housing and other parts, and is guided to a gap D leading to the adjacent control button 13. A rib 13*b* for preventing light leakage is provided as a protruding component to this portion of one control button 13, and the adjacent control button 13 is provided with a step 13*c* for preventing light leakage by ensuring enough distance from this light blocking rib 13*b* to permit the depression displacement of the switch, so these block bulb light and prevent the leakage of this light. The result of this is that each of the control buttons 13 stands out more distinctly. Nevertheless, because there is a stepped gap with this structure, the rib 13*b* for preventing light leakage and the step 13*c* for preventing light leakage presented here are unable to block the light completely because of the scattered reflection of the light.

SUMMARY OF THE INVENTION

It is an object of the present invention to provide a push button switch with a light blocking structure that is efficient and permits the button to be pushed in, which is disposed adjacent to other push button switches on the same substrate in a direction perpendicular to the direction in which the button is pushed in, so that the light from light sources assigned different functions will not interfere one with the other.

The push button switch of the present invention comprises LEDs disposed adjacent to each other on the same substrate, two light barriers erected apart from each other and in between the LEDs, and one light barrier provided on the back side of a control knob, wherein the distal end of the one light barrier is in a positional relationship of fitting into the gap between the two light barriers, and the two light barriers are tall enough to permit the displacement of the one light barrier when the control knob is pushed in.

In a preferred embodiment of the push button switch of the present invention, a substrate, on which two LEDs are mounted adjacent to each other, and in which a plurality of fitting holes are made, is combined with a base structure, in which at least two support arms and two light barriers are given an integral structure, and from which a plurality of wiring terminals protrude, the substrate is placed on the support arms in a state of being in contact with the lower ends of the two light barriers, and the wiring terminals are fitted into the plurality of fitting holes and soldered in place.

In an even more preferred embodiment, there is employed a combination of a base structure in which the base side of the two light barriers is formed long enough to extend past the substrate and the upper distal ends of the support arms are given a slanted shape, with a substrate in which a cut-out is formed for accommodating the two light barrier portions formed extending in the length.

With the push button switch of the present invention, since the LEDs are mounted adjacent to each other on the same substrate ahead of time, they are easy to attach. Also, since this switch comprises two light barriers erected apart from each other and in between the LEDs, and one light barrier provided on the back side of a control knob, and the distal end of the one light barrier is in a positional relationship of fitting into the gap between the two light barriers, and the two light barriers are tall enough to permit the displacement of the one light barrier when the control knob is pushed in, not only will the light barriers permit the switch to be pushed in, but since the gap between the two light barriers is formed in a U shape, any light that is scattered upon reflection will be blocked by the labyrinth structure thereof, so the light from the spaces on one side does not interfere with that on the other side.

Also, in a preferred embodiment of the push button switch of the present invention, since two LEDs are mounted adjacent to each other, a substrate in which a plurality of fitting holes have been made, at least two support arms, and two light barriers are given an integral structure, this is combined with a base structure from which a plurality of wiring terminals protrude, the substrate is placed on the support arms in a state of being in contact with the lower ends of the two light barriers, and the wiring terminals are fitted into the plurality of fitting holes and soldered in place, stable contact can be maintained between the substrate and the two light barriers, allowing the leakage of light to be prevented more effectively.

In an even more preferred embodiment of the push button switch of the present invention, since there is employed a combination of a base structure in which the base side of the two light barriers is formed long enough to extend past the substrate and the upper distal ends of the support arms are given a slanted shape, with a substrate in which a cut-out is formed for accommodating the two light barrier portions formed extending in the length, in the assembly thereof, the substrate is inserted along the slanted shape of the support arms so that the cut-out will accommodate the two light barrier portions, after which the substrate is made horizontal so that the wiring terminals will fit into the plurality of fitting holes, and can be soldered in place. This not only allows the work to be carried out smoothly, it also effectively prevents the leakage of light by forming a tight-fitting structure between the substrate surface and the lower ends of the two light barriers, and between the cut-out end of the substrate and the two light barriers.

DESCRIPTION OF THE PREFERRED EMBODIMENTS

Figure 1:
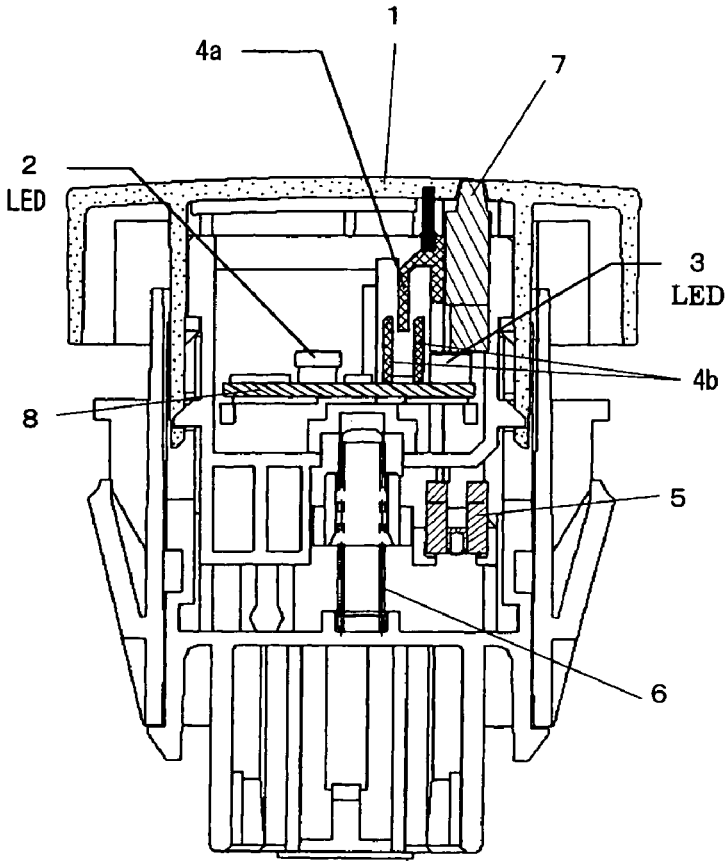
FIG. 1 is a cross section illustrating an embodiment of the present invention.
Figure 5:
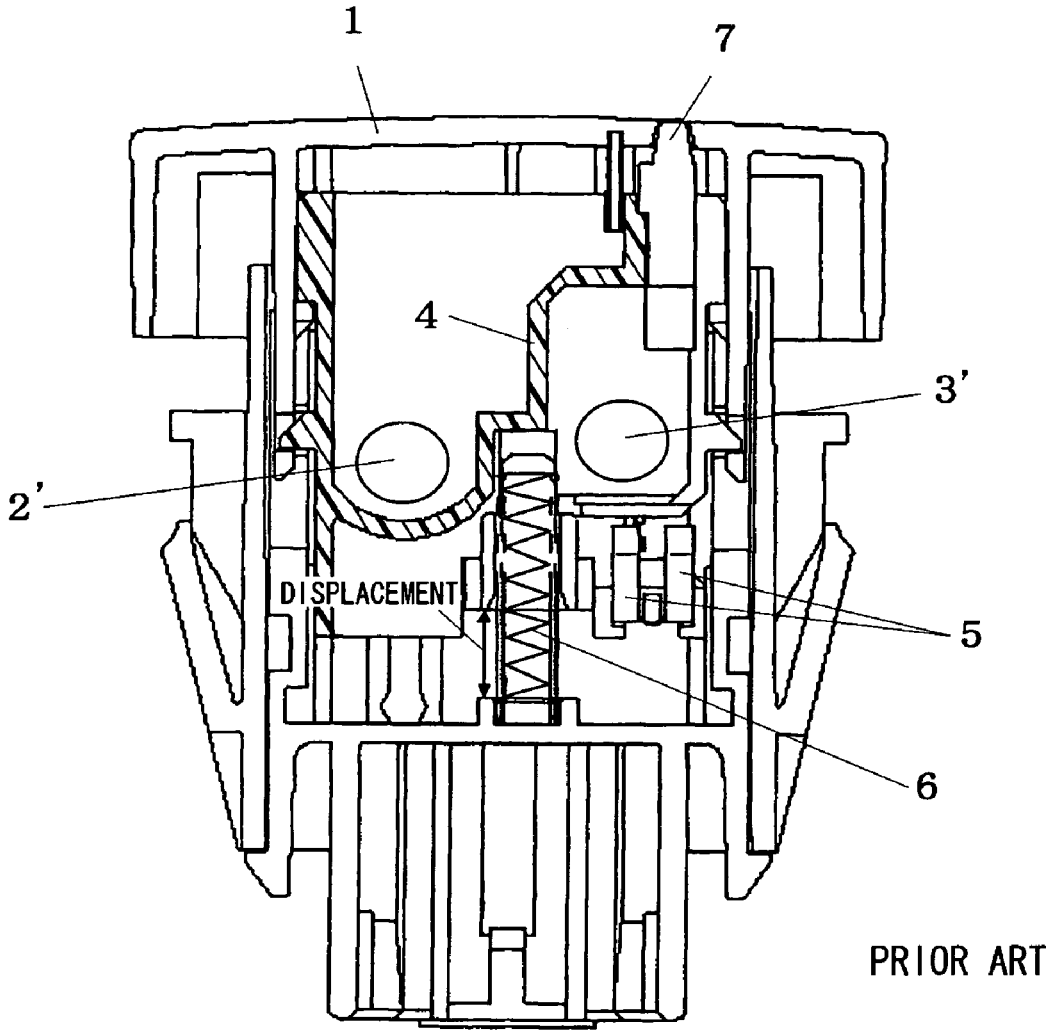
FIG. 5 is a cross section illustrating the structure of a push button switch whose light source is a conventional miniature light bulb.
Figure 6:
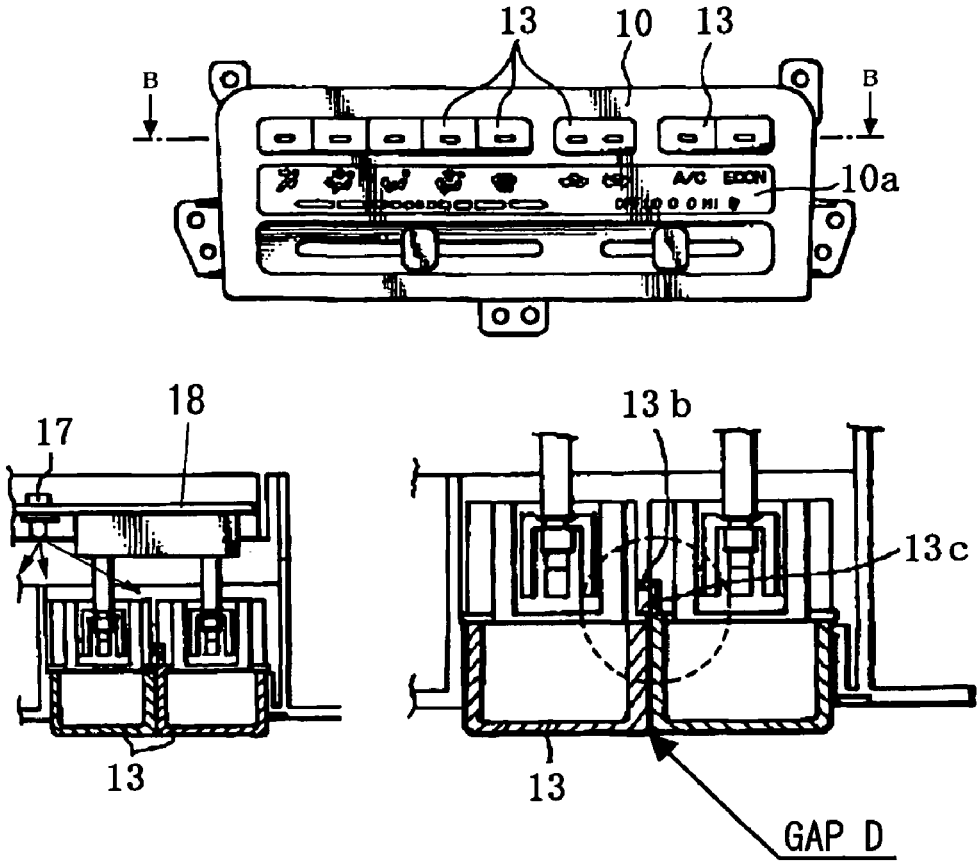
FIG. 6 is a diagram illustrating an example of the light blocking structure in a conventional switch device.

FIG. 1 is a cross section illustrating an embodiment of a push button switch equipped with a backlight function pertaining to the present invention. The basic structure as a switch is very similar to that of the conventional device shown in FIG. 5, but the major differences are that LEDs 2 and 3 are employed for the light sources used for nighttime illumination and for operational display, that these two LEDs are mounted on a single substrate 8, and in the structure of the barriers that prevent interference between the two light sources between the substrate 8 to which the LEDs are fixed and the control knob 1 that is depressed. The structure of the light transmitting member 7 that guides the operational display light to the required portion of the control knob 1, and of the slide contact 5 and the spring 6 used as a push-push and the operation of these as a switch, are the same as those of a conventional device. Two light barriers 4*b* are erected on the substrate surface, spaced apart between the LEDs, so that the light from an LED 2 used for nighttime illumination and the light from an LED 3 used for operational display, which are mounted adjacent to each other on the same substrate 8, do not interfere with each other. These light barriers 4*b* are not displaced related to the substrate 8, and do not move relative to the depression of the control knob 1. A single light barrier 4*a* is provided on the back side of the control knob and across from the light barriers 4*b*. This light barrier 4*a* is displaced integrally with the control knob 1. In the initial state of the push button switch, the distal end of the single light barrier 4*a* is in a positional relationship of fitting into the gap between the two light barriers 4*b*, and when the control knob 1 is pushed, the distal end of the light barrier 4*a*, which has an integral structure, moves toward the substrate 8 by an amount equal to the depressed displacement. The two light barriers 4*b* are tall enough to permit the displacement of the single light barrier 4*a* during this operation. A light blocking structure involving a combination of this single light barrier 4*a* and the two light barriers 4*b* is a labyrinth structure in which the two light barriers 4*b* sandwich the single light barrier 4*a*, and there is a U-shaped gap between the two. Although there is a gap, it is a U-shaped gap, as opposed to a stepped gap as in Patent Document 1, so scattered light is less likely to leak out with this structure. Because the fit is shallow when the switch is in its initial off state, and is deep when the switch is pushed on, a state of no leakage can be attained with a state of shallow meshing, and this determines the design dimensions of the light barriers.

Figure 3:
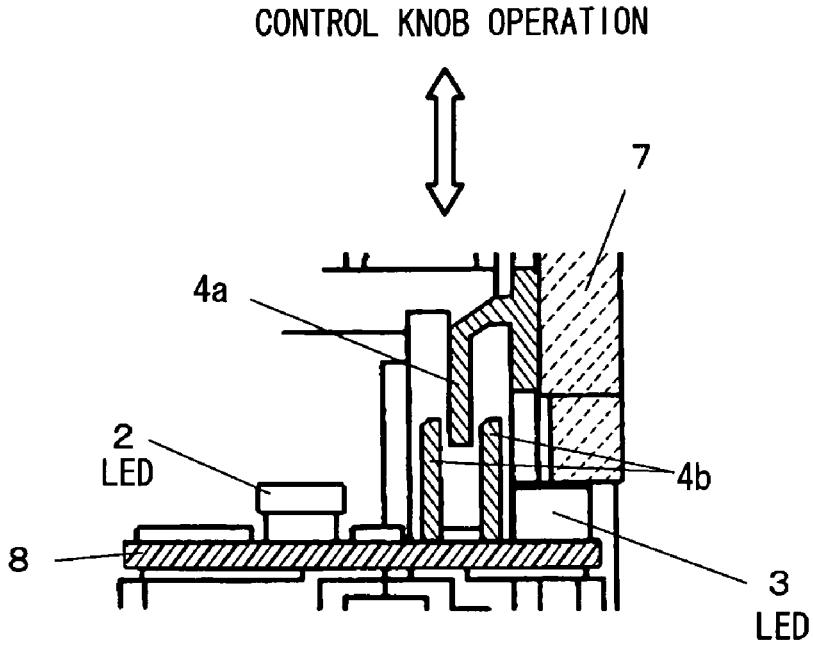
FIG. 3 is a detail view of the light blocking structure of the present invention.

The mechanism by which the light blocking structure of the push button switch of the present invention, which affords high efficiency and permits the switch to be depressed, is achieved will be described in detail through reference to the detail view shown in FIG. 3. First, let us assume that the LED 2 used for nighttime illumination and the LED 3 used for operational display, which are disposed adjacent to each other on the substrate 8, are both attached facing upward, and that they emit light in a 180° direction. Since the two light barriers 4*b* are disposed between the two LEDs 2 and 3, one LED region is not irradiated directly by light from the other. The height of the two light barriers 4*b* is the depression stroke of the control knob 1 plus alpha. This alpha is at least the distance that the light barrier 4*a* and the light barriers 4*b* mesh together in the initial position of the control knob 1. As discussed above, there is a U-shaped gap between the single light barrier 4*a* and the two light barriers 4*b*, and unless light should get around this gap, it will not reach the other region. This gap opens downward, while the light is emitted upward from the light sources, so only light reflected from above can be incident. Furthermore, any light that should leak into the gap would have to go through a gap that opens upward before it could reach the other region. Light that is incident on this gap from above is further reflected downward within this gap, and must exit upward. Since it would be difficult for light to pass through this gap by simple reflection because of the structure, the only way for light to leak out is through repeated scattering reflection. However, since the light barriers 4*a* and 4*b* are, of course, a black surface or other such surface that does not reflect much light, the reflection efficiency is exceedingly low. Thus, the light barriers of the present invention are extremely effective at blocking light because of their labyrinth structure.

Figure 4:
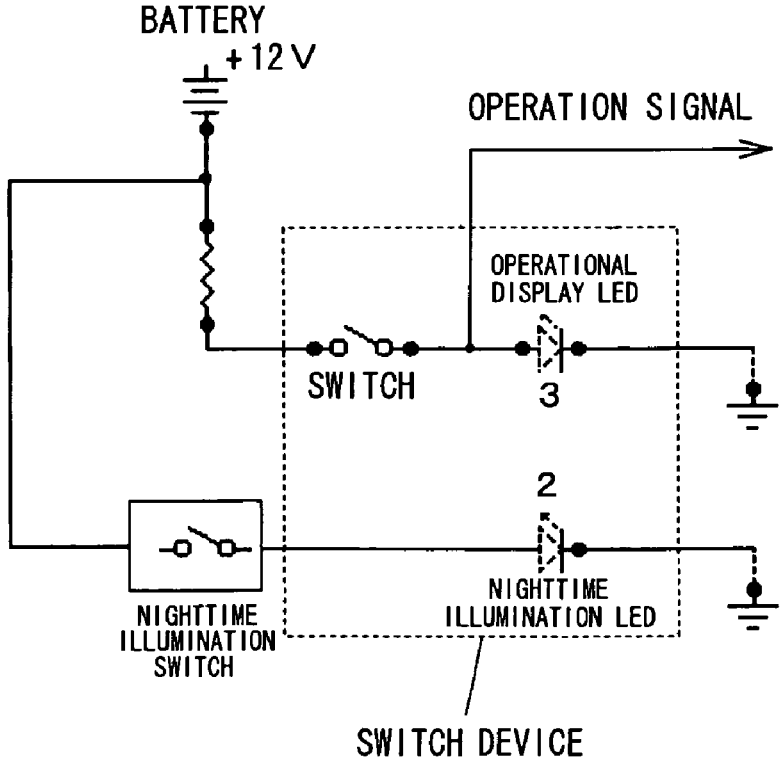
FIG. 4 is a circuit diagram illustrating the operation of the push button switch pertaining to the present invention.

Next, the operation of the circuit of the push button switch of the present invention will be described through reference to FIG. 4. The push button switch of the present invention is the portion bounded by the dotted line. The nighttime illumination LED 2, the operational display LED 3, and a slide switch are built into this switch device, and this switch is connected in series with the operational display LED 3. A nighttime illumination switch disposed outside the above-mentioned switch device is also connected in series to the nighttime illumination LED 2, and the other ends of the two switches are connected to a battery. When the nighttime illumination switch is turned on a night, the nighttime illumination LED 2 is lit and shines on the back of the control knob 1, so that the location of the control knob 1 of this switch device stands out. When this push button switch is pushed, the slide contact puts the switch in its on state and lights the operational display LED 3, so that the specific operational signal is sent. For instance, this operation may be a switch for a corner sensor provided to a bumper.

WORKING EXAMPLES

Figure 2:
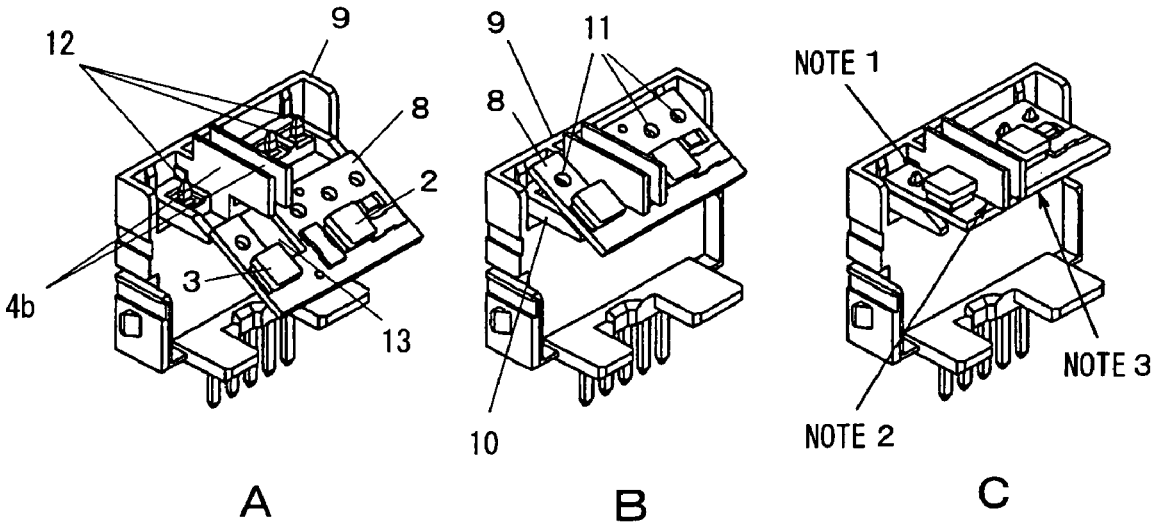
FIG. 2 is a diagram illustrating the assembly structure of the base structure and substrate in a working example.

In embodying the above constitution, it is preferable in terms of work efficiency if the two LEDs 2 and 3 are mounted on the substrate 8 ahead of time, before the constituent members are assembled. The inventors came up with the constitution shown in FIG. 2 as a sound structure with which the substrate 8 can be easily attached to a base structure 9 on which are disposed the two light barriers 4*b* and a plurality of wiring terminals 12, and furthermore there is no leakage of light between the light barriers 4*b* and the substrate 8 in an assembled state. The nighttime illumination LED 2 and the operational display LED 3 are mounted ahead of time on the substrate 8, which is provided with a plurality of fitting holes 11 into which the plurality of wiring terminals 12 are fitted, and partially with a cut-out 13 for accommodating the two light barriers 4*b*. Also, the two light barriers 4*b* are installed as an integral structure above the base structure 9 (the direction of the control knob 1 is considered to be upward for the sake of convenience in this Specification), the plurality of wiring terminals 12 are disposed protruding upward, and at least two support arms 10 that support the substrate 8 are disposed extending out laterally. The upper distal ends of the plurality of support arms 10 are cut in a slanted shape, as can be seen in FIG. 2A. The base side of the two light barriers 4*b* is formed long enough to extend past the position where the substrate 8 is attached, and the cut-out 13 provided to the substrate 8 is formed so as to match up with the length of the two light barriers 4*b* on the base side and the outer surface spacing of the two light barriers 4*b*.

The base structure 9 and the substrate 8 in which the above structure is employed are assembled as shown in time series in FIGS. 2A, 2B, and 2C. Specifically, as shown in A, the substrate 8 is inserted diagonally upward along the distal end slanted surface of the support arms 10, and the two light barriers 4*b* are sandwiched into the cut-out 13. Once the substrate 8 has been inserted up to the state shown in B, the lower side of the substrate 8 is rotated away from the distal end slanted surface of the support arms 10 so as to come into contact with the horizontal surface of the support arms 10. As a result, as shown in C, the plurality of wiring terminals 12 of the base structure 9 protrude through the plurality of fitting holes 11 made in the substrate 8 (note 1), and a tight-fitting structure is produced in which the two light barriers 4*b* and the end of the cut-out 13, and the lower ends of the two light barriers 4*b* and the surface of the substrate 8 (note 2) effectively prevent the leakage of light. To fix this configuration, the portion indicated by note 3 is held in a jig while the plurality of wiring terminals 12 of the note 1 portion are soldered in place on the substrate 8. In this assembly, a configuration in which the cut-out 13 accommodates the extended portion of the two light barriers 4*b*, a configuration in which the lower side of the substrate 8 comes into contact with the horizontal surface of the support arms 10, and a configuration in which the surface of the substrate 8 is in contact with the lower ends of the two light barriers 4*b* complement each other and afford more effective positioning in the up and down direction.

What is claimed is:

1. A push button switch, comprising:

LEDs disposed adjacent to each other on the same substrate;

two light barriers disposed on said substrate and erected apart from each other and in between said LEDs; and one light barrier provided on the back side of a control knob, wherein the distal end of said one light barrier is in a positional relationship of fitting into a gap between the two light barriers, and the two light barriers are tall enough to permit the displacement of said one light barrier when the control knob is pushed in, and the substrate, on which two LEDs are mounted adjacent to each other, and in which a plurality of fitting holes are made, is combined with a base structure in which at least two support arms and two light barriers are given an integral structure, and from which a plurality of wiring terminals protrude, the substrate is placed on the support arms in a state of being in contact with the lower ends of the two light barriers, and the wiring terminals are fitted into the plurality of fitting holes and soldered in place.

2. The push button switch according to claim 1, comprising the combination of the base structure, in which the base side of the two light barriers is formed long enough to extend past the substrate and the upper distal ends of the support arms are given a slanted shape, with a substrate in which cut-outs are formed for fitting in the two light barrier portions formed extending in said length.

* * * * *